US006376810B2

(12) United States Patent
Higgins

(10) Patent No.: US 6,376,810 B2
(45) Date of Patent: Apr. 23, 2002

(54) RADIANT ELECTRIC HEATER

(75) Inventor: George Anthony Higgins, Hagley (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/822,557

(22) Filed: Mar. 30, 2001

(30) Foreign Application Priority Data

Apr. 3, 2000 (GB) ..... 0008030

(51) Int. Cl.[7] ..... H05B 3/74
(52) U.S. Cl. ..... 219/448.11; 219/460.1
(58) Field of Search ..... 219/448.11, 460.1, 219/446.1, 481, 461.11, 464.1, 462.1

(56) References Cited

U.S. PATENT DOCUMENTS 4,447,711 A * 5/1984 Fischer ..... 219/448.11
4,508,961 A * 4/1985 Mcwilliams ..... 219/448.11
4,700,051 A * 10/1987 Goessler et al. ..... 219/448.11
5,001,328 A * 3/1991 Schreder et al. ..... 219/447.1
5,043,559 A * 8/1991 Scott ..... 219/464.1
5,396,047 A * 3/1995 Schilling et al. ..... 219/448.11
6,018,147 A * 1/2000 Higgins ..... 219/461.1
6,018,148 A * 1/2000 Wilkins ..... 219/461.1
6,121,587 A * 9/2000 Leiprecht et al. ..... 219/448.16
6,229,119 B1 * 5/2001 Petri et al. ..... 219/448.11
6,285,012 B1 * 9/2001 Connolly et al. ..... 219/481
2001/0003335 A1 * 6/2001 Griffiths et al. ..... 219/446.1
2001/0023867 A1 * 9/2001 Wilkins ..... 219/448.11

* cited by examiner

*Primary Examiner*—Teresa Walberg
*Assistant Examiner*—Leonid M Fastovsky
(74) *Attorney, Agent, or Firm*—Ira S. Dorman

(57) ABSTRACT

A radiant electric heater comprises concentrically-arranged heating elements separated by a dividing wall to form inner and outer heating zones, the heater having a peripheral wall. A tunnel extends between the peripheral wall and the dividing wall. A rod-like temperature-responsive device extends through the tunnel and across the inner heating zone. An end portion of the inner element extends along the tunnel. A terminal block is located at the periphery of the heater, end portions of the inner and outer elements being electrically connected to terminals provided in the terminal block. An elongate electrically conductive link is provided having a first end electrically connected to one terminal and bridging an end portion of the outer element connected to another terminal, the link being profiled such that a second end thereof is located within the tunnel and connected to an end portion of the inner element.

24 Claims, 5 Drawing Sheets

RADIANT ELECTRIC HEATER

RADIANT ELECTRIC HEATER

The present invention relates to radiant electric heaters, such as for use in cooking appliances and more especially for use in cooking appliances having glass-ceramic cooking surfaces.

DESCRIPTION OF PRIOR ART

It is well known to provide a radiant electric heater for use in a cooking appliance beneath a glass-ceramic cooking surface and in which at least two concentrically-arranged heating elements, separated by a dividing wall of thermal insulation material, are supported on or adjacent to a base of thermal insulation material, such as microporous thermal and electrical insulation material. An outer heating zone and an inner heating zone are thereby provided, the inner heating zone having one or more heating elements which are generally arranged to be energisable independently of the heating element or elements of the outer heating zone.

A peripheral wall of thermal insulation material is generally arranged around the edge of the heater and a rod-like temperature-responsive device extends from a periphery of the heater across the heater to a position at least partly across the inner heating zone.

In order to meet a requirement that the temperature-responsive device should be responsive substantially only to heat from the inner heating zone, even when both inner and outer heating zones are energised, it is known to provide a tunnel of thermal insulation material supported on the base and covering the rod-like temperature-responsive device between the peripheral wall and the dividing wall in the outer heating zone. The heating element in the outer heating zone is arranged to stop short of the tunnel at either side thereof and hence does not intrude into the tunnel. The temperature-responsive device is thus thermally isolated from the heating element in the outer heating zone.

It is further known to provide one or more end portions of the heating element of the inner heating zone extending into the tunnel through an aperture in the dividing wall. Such one or more end portions of the heating element are led through the tunnel and out to terminals of a terminal block, located at the edge of the heater, for electrically connecting the element of the inner heating zone to a power supply. The terminal block is generally located near the end of the temperature-responsive device at the edge of the heater.

The heating element of the outer heating zone also has end portions which are electrically connected to terminals in the terminal block and it is usual to provide a common terminal to which is electrically connected an end portion of the heating element of the outer heating zone and also an end portion of the heating element of the inner heating zone. Two further terminals are usually provided, one connected to another end portion of the heating element of the inner heating zone and the other connected to another end portion of the heating element of the outer heating zone.

Such an arrangement has hitherto placed a restriction on the possible permutations available for making external connections to the terminal block. The common terminal was generally restricted to a position intermediate the other two terminals because if it was required, for example, to provide the common terminal as one of the other terminals, particularly a terminal nearer the temperature-responsive device, the other end portion of the heating element of the outer heating zone leading thereto would provide a barrier against connection of the other end portion of the heating element of the inner heating zone to one of the remaining terminals.

OBJECT OF THE INVENTION

It is an object of the present invention to overcome or minimise this problem.

SUMMARY OF THE INVENTION

According to the present invention there is provided a radiant electric heater comprising: a base of thermal insulation material having supported relative (thereon or adjacent) thereto at least two concentrically-arranged heating elements separated by a dividing wall of thermal insulation material to form an outer heating zone and an inner heating zone, the heater having a peripheral wall of thermal insulation material; a tunnel formed of thermal insulation material extending between the peripheral wall and the dividing wall across the outer heating zone; a rod-like temperature-responsive device extending from a periphery of the heater through the tunnel and at least partly across the inner heating zone, through an aperture provided in the dividing wall; one or more end portions of one or more heating elements of the inner heating zone extending along the tunnel; a terminal block located at the periphery of the heater, the one or more end portions of the one or more heating elements of the inner heating zone and one or more end portions of one or more heating elements of the outer heating zone being electrically connected to terminals provided in the terminal block; an elongate electrically conductive link being provided having a first end electrically connected to, or comprising, one of the terminals and extending to bridge, whilst being electrically insulated from, an end portion of the one or more heating elements of the outer heating zone electrically connected to another terminal, the link being profiled such that a second end thereof is located within the tunnel and electrically connected to an end portion of the one or more heating elements of the inner heating zone.

The heating element or elements of the outer heating zone may be substantially absent from an area occupied by the tunnel.

The electrically conductive link may be of substantially rigid form and may be arranged to bridge, in spaced relationship with, the end portion of the one or more heating elements of the outer heating zone.

The tunnel may have a lower side edge profiled to accommodate entry of the link into the tunnel and also may provide secure location for the link. For this purpose the lower side edge of the tunnel may be notched, apertured, rebated or grooved.

The link may be substantially secured in the longitudinal and/or lateral direction of the tunnel by the profiled lower side edge of the tunnel.

The second end of the link may be provided with means for securing it to the base of thermal insulation material, which means may comprise a spike or pin. Such spike or pin may be integral with, or separate from, the second end of the link.

The link may be profiled such that it has a first upwardly-directed portion in the region of (at or near) the first end thereof, a second laterally-directed portion crossing over the end portion of the one or more heating elements of the outer heating zone, a third portion downwardly directed towards the base and a fourth portion laterally directed into the tunnel at the second end of the link. Additionally, the second end of the link may be directed downwardly towards the base.

The second end of the link may be welded to the end portion of the one or more heating elements of the inner heating zone.

The link may comprise metal and may be of strip form.

Another end portion of the one or more heating elements of the inner heating zone may be electrically connected to a different terminal in the terminal block from that terminal electrically connected to, or comprising, the link.

The tunnel may be provided with a laterally-extending portion proximate the peripheral wall and adapted to shield such other end portion of the one or more heating elements of the inner heating zone. Such other end portion of the one or more heating elements of the inner heating zone may be electrically connected to the same terminal in the terminal block as the bridged end portion of the one or more heating elements of the outer heating zone.

The tunnel and/or the peripheral wall and/or the dividing wall may comprise bound vermiculite.

The tunnel may be integral with the dividing wall and/or the peripheral wall.

The base may comprise microporous thermal and electrical insulation material.

The heating elements may be of ribbon form and may be supported edgewise on the base.

The electrically conductive link in the present invention which is, in effect, mechanically coupled to the tunnel, provides reliable crossing of a heating element without risk of contact therewith. Risk of movement of the link in service is minimised as a result of its securing at the tunnel at one end and at the terminal block at the other end.

For a better understanding of the invention and to show more clearly how it may be carried into effect, reference will now be made by way of example to the accompanying drawings in which:

DESCRIPTION OF PREFERRED EMBODIMENTS

Figure 1:
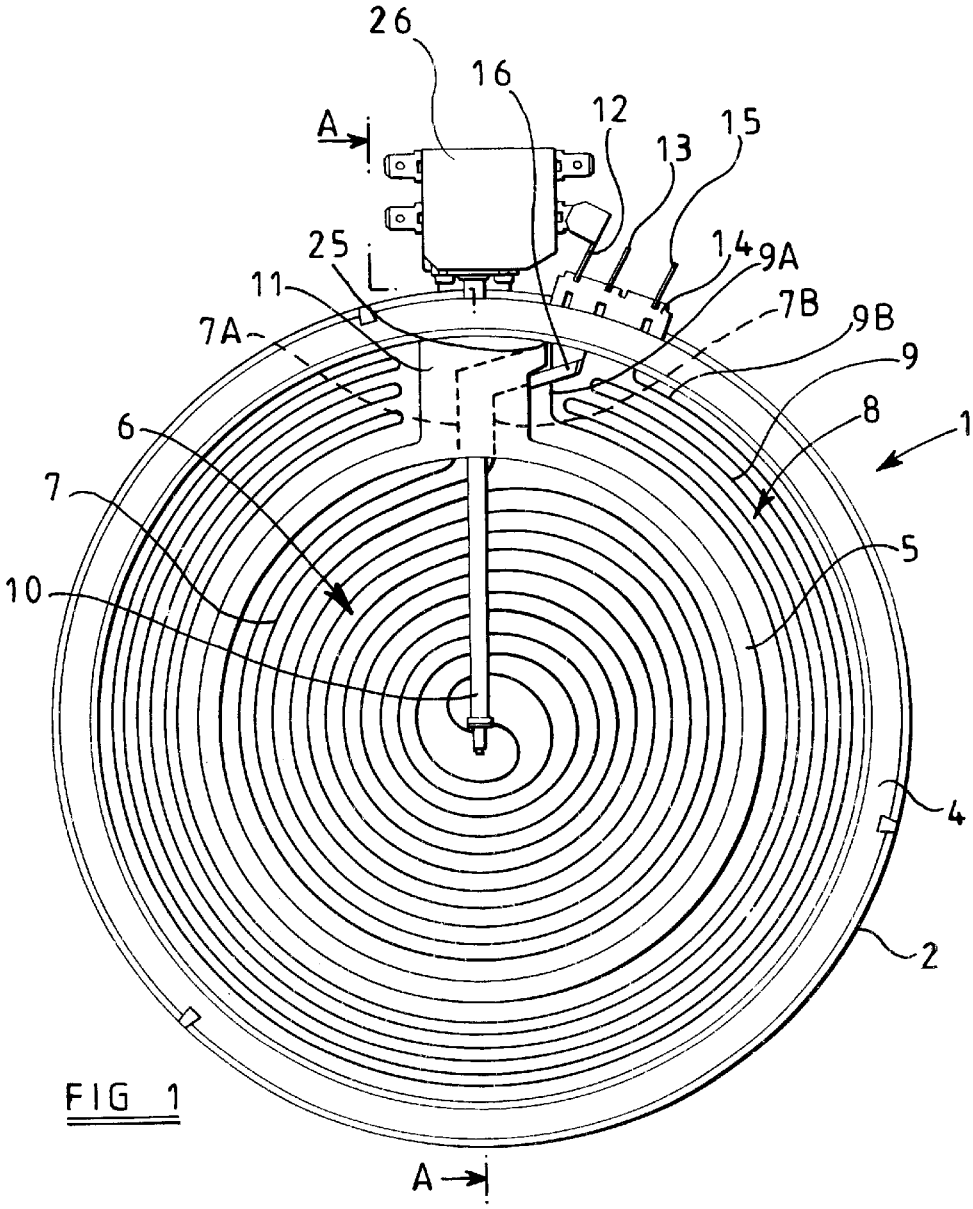
FIG. 1 is a plan view of one embodiment of a radiant electric heater according to the present invention.
Figure 2:
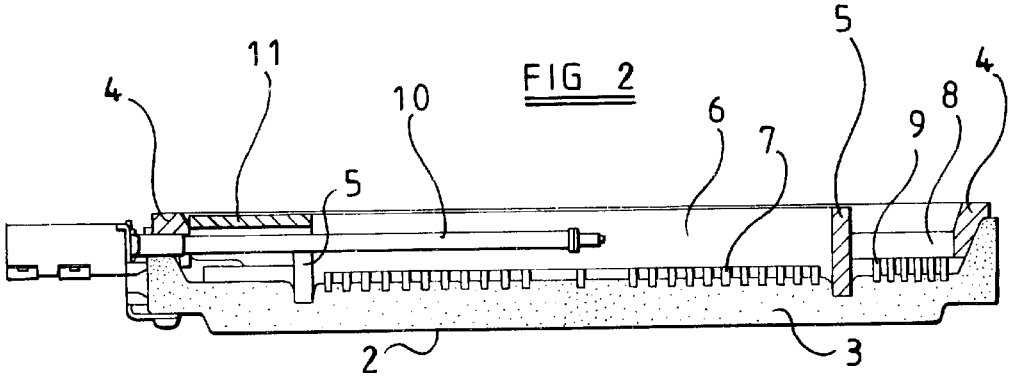
FIG. 2 is a cross-sectional view of the heater of FIG. 1.
Figure 3:
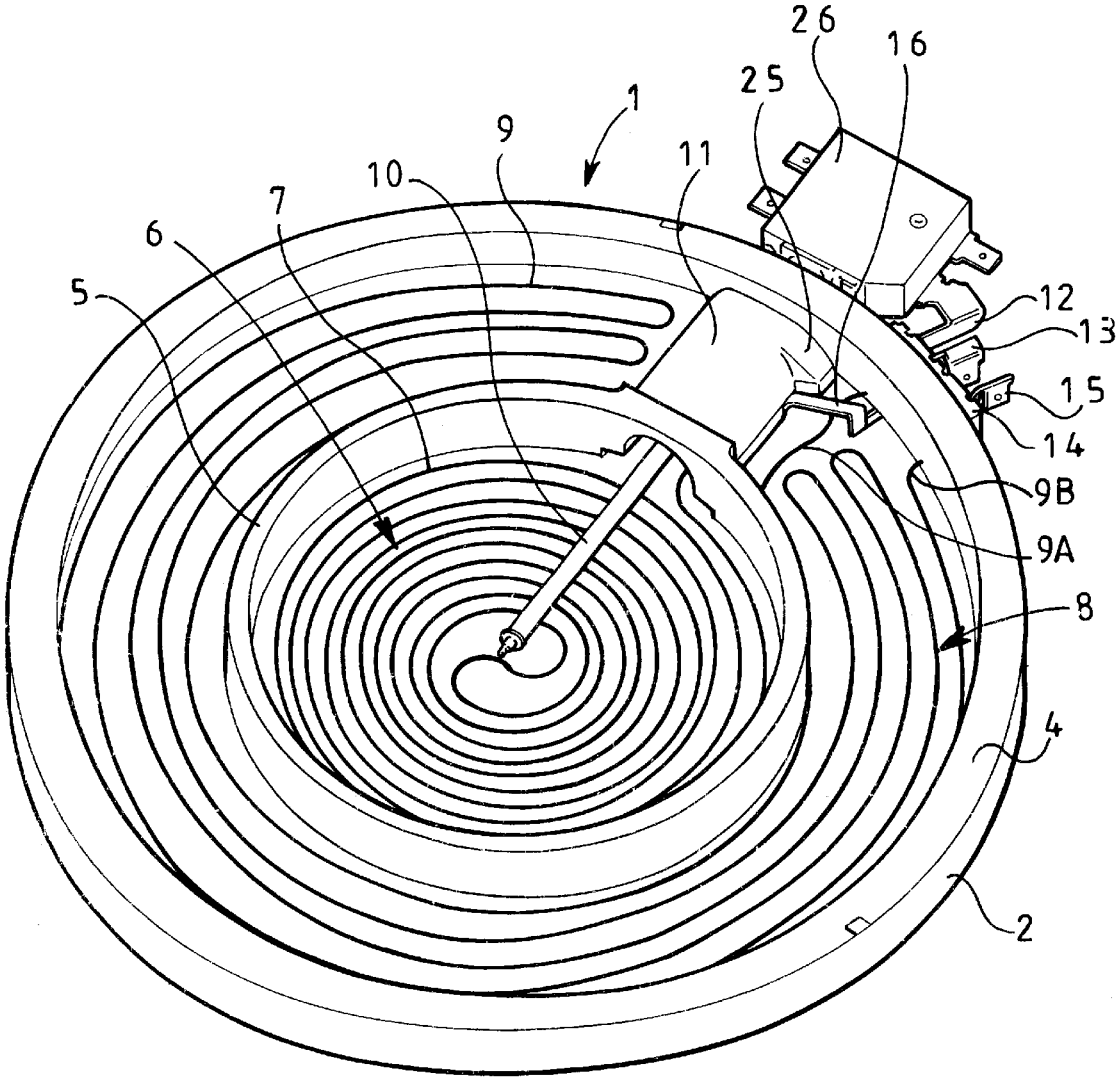
FIG. 3 is a perspective view of the heater of FIG. 1.

Referring to FIGS. 1, 2 and 3, a radiant electric heater 1, for use under a glass-ceramic surface (not shown) of a cooking appliance, has a metal support dish 2 containing a base 3 of microporous thermal and electrical insulation material. A peripheral wall 4 of thermal insulation material, such as bound vermiculite, is provided around the outside edge of the heater. Such vermiculite suitably comprises exfoliated particles of vermiculite bound with potassium silicate.

Two heating zones are provided, separated by a dividing wall 5 of thermal insulation material, such as bound vermiculite. An inner heating zone 6 contains at least one heating element 7, supported on the base 3 and suitably comprising one or more edgewise-mounted corrugated ribbons. An outer heating zone 8 contains at least one heating element 9, of similar form to the heating element 7.

A rod-like temperature-responsive device 10 of well-known form extends across the heater from the periphery thereof and partly across the inner heating zone 6, through an aperture provided in the dividing wall 5.

In order that the temperature-responsive device 10 can be made responsive to heat generated only by the one or more heating elements 7 in the inner heating zone 6, even when the one or more heating elements 9 in the outer heating zone 8 is or are energised, a tunnel 11 of thermal insulation material, such as bound vermiculite, is provided. The tunnel 11 is of substantially inverted U-shaped cross-section and extends between the peripheral wall 4 and the dividing wall 5, covering the rod-like temperature-responsive device 10 in this region. The one or more heating elements 9 in the outer heating zone 8 is or are arranged to stop short of the tunnel 11. The temperature-responsive device 10 is therefore thermally isolated by the tunnel 11 from the heating element or elements 9 of the outer heating zone 8.

End portions 7A and 7B of the one or more heating elements 7 of the inner heating zone 6 are arranged to pass directly or indirectly through the tunnel 11, for electrical connection to terminals 12 and 13 of a terminal block 14 provided at a peripheral edge of the heater.

The end portion 7A is electrically connected to terminal 12 and an end portion 9A of the one or more heating elements 9 of the outer heating zone 8 is also electrically connected to terminal 12. The terminal 12 therefore serves as a common terminal for the heating elements 7 and 9.

The one or more heating elements 9 of the outer heating zone 8 also have another end portion 9B electrically connected to a terminal 15 of the terminal block 14.

For the end portion 7B of the one or more heating elements 7 of the inner heating zone 6 to be electrically connected to the terminal 13 of the terminal block 14, it is necessary to cross the end portion 9A of the one or more heating elements 9 of the outer heating zone 8. Such crossing must be without risk of electrical contact between the two end portions and be reliable under high temperature conditions prevailing in the heater and also when subjected to mechanical shock.

As will now be described in detail with particular reference to FIGS. 4 to 7, an elongate electrically conductive link 16 is provided which has one end connected to, or forming part of, terminal 13 of the terminal block 14. The link 16 bridges the end portion 9A of the one or more heating elements 9 and enters the tunnel 11 where it is connected at its other end to the end portion 7B of the one or more heating elements 7.

The electrically conductive link 16 is suitably formed of substantially rigid metal strip material. It is profiled such that it has a first end 17 connected, such as by welding, or forming part of, to the terminal 13 of the terminal block 14. The link 16 has an upwardly-directed portion 18, at or near the first end 17, and a laterally-directed portion 19 crossing over, while being spaced from, the end portion 9A of the one or more heating elements 9 of the outer heating zone. A further portion 20 of the link 16 is downwardly-directed towards the base 3 of the heater, followed by a still further portion 21 of the link which is laterally-directed into the tunnel 11. The link 16 therefore forms a bridge over the end portion 9A of the heating element or elements 9.

Figure 4:
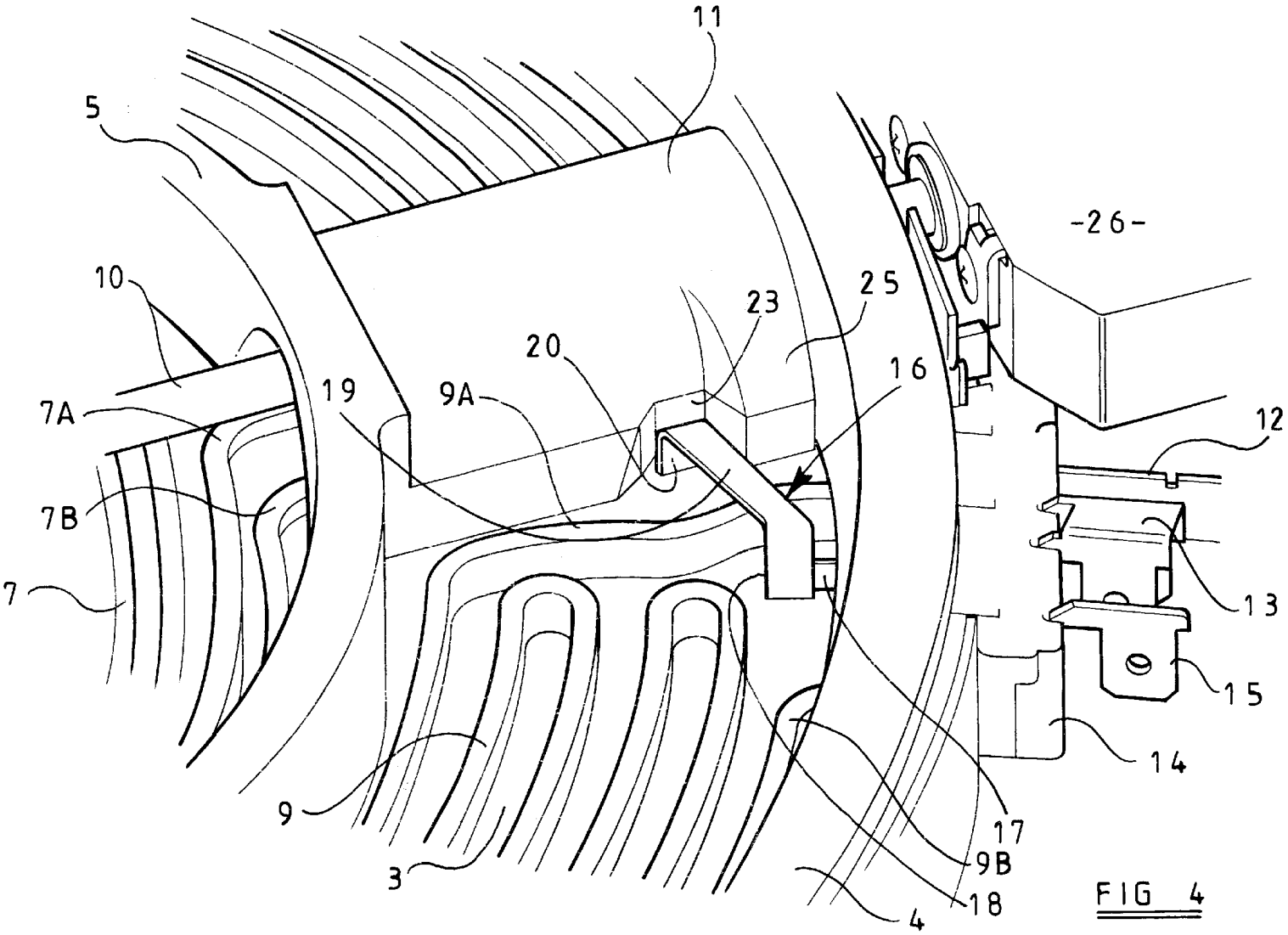
FIG. 4 is a detailed perspective view of part of the heater of FIG. 1.
Figure 5:
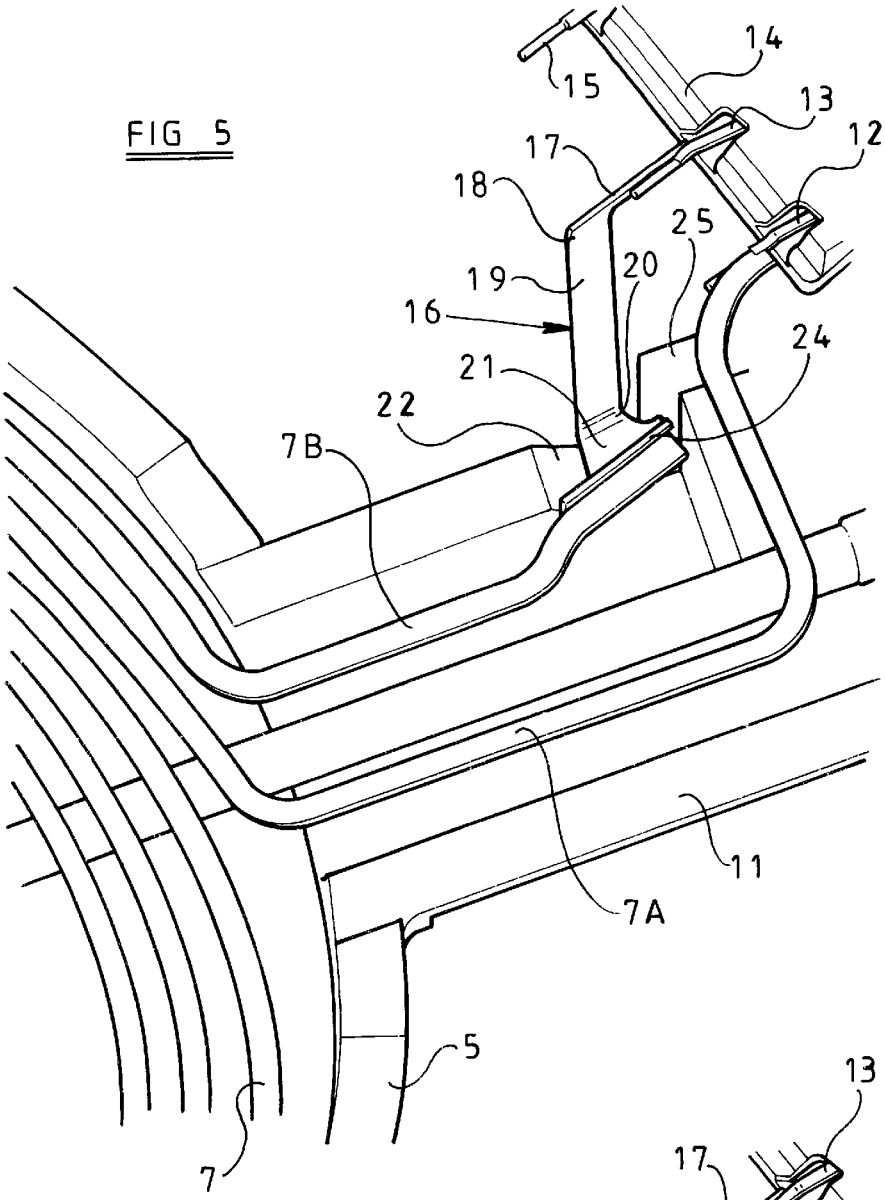
FIG. 5 is an underside view of a tunnel region of the heater of FIG. 1.

As shown particularly in FIGS. 4 and 5, the tunnel has profiled regions 22, 23, suitably in the form of one or more notches, apertures, rebates or grooves, at its lower side edge to securely locate the link and allow it to enter the tunnel 11 between the lower edge of the tunnel and the base 3.

A second end 24 of the link 16 is secured, for example by welding, to the end portion 7B of the one or more heating elements 7 inside the tunnel 11.

Figure 7:
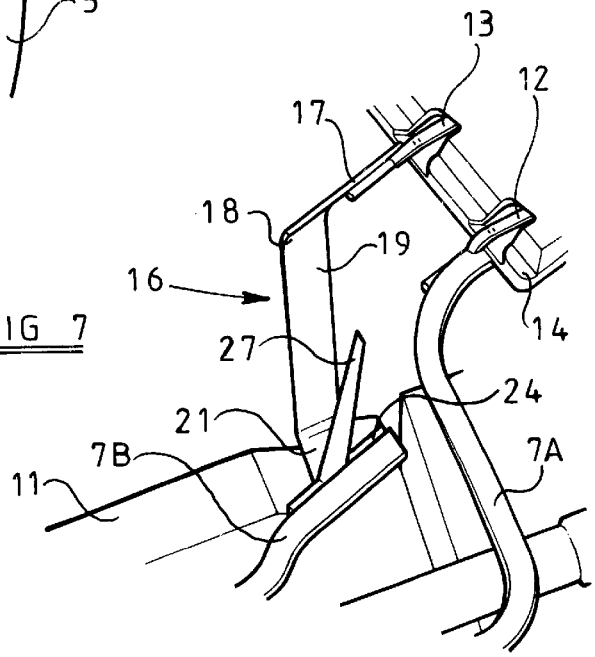
FIG. 7 is a modification of part of FIG. 5, showing a spike or pin securing the electrically conductive link inside the tunnel of the heater.
Figure 6:
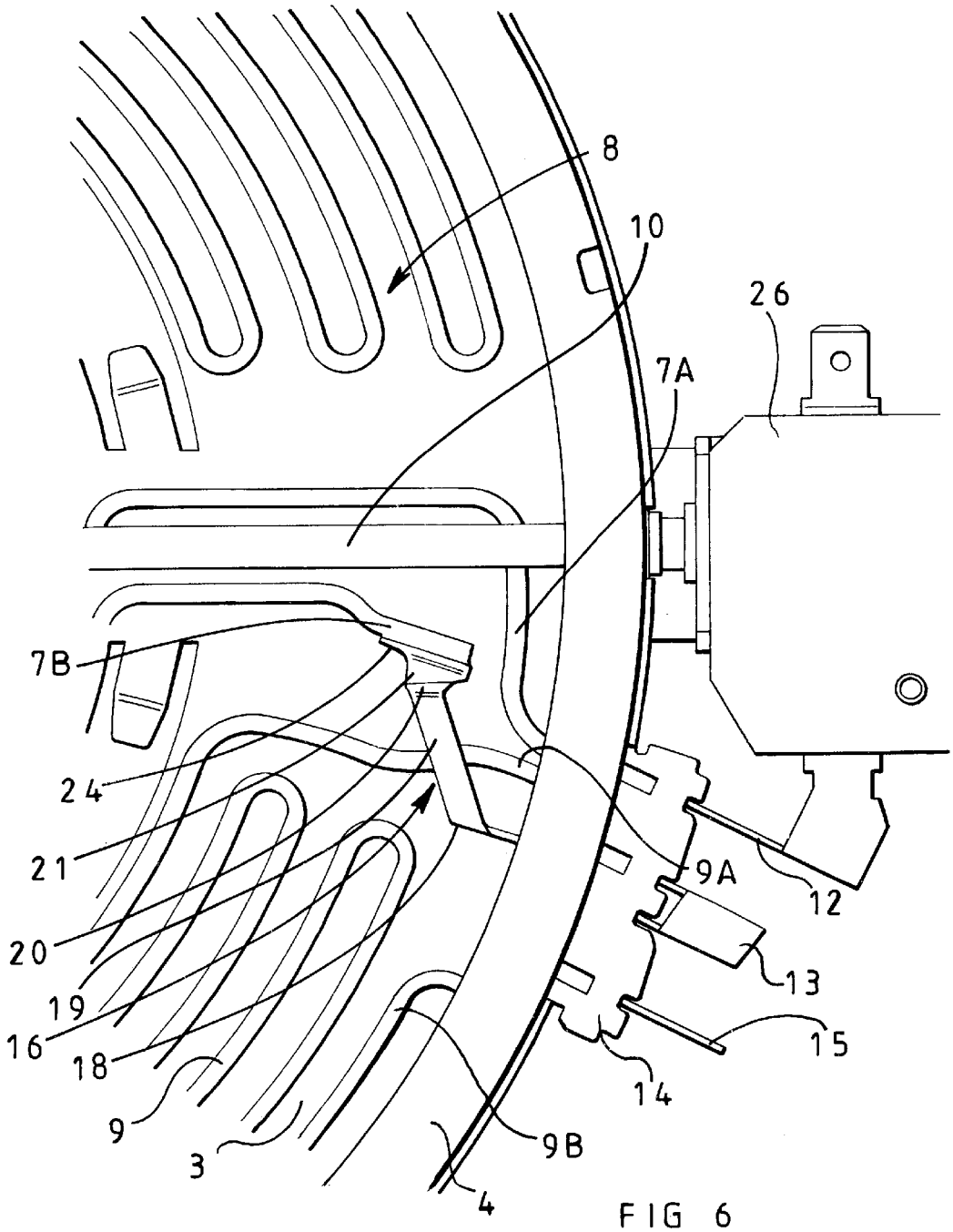
FIG. 6 is a top view of part of the heater of FIG. 1 with the tunnel thereof removed.

FIG. 7 is a modification of FIG. 5, in which a spike or pin 27 is provided on the link 16 at or near the second end 24 thereof. Such spike or pin 27 is inserted into the base 3 to provide additional securing of the link 16. The spike or pin 27 can be integral with, or separate from, the end of the link 16.

A lateral extension 25 can be provided on the tunnel 11 in the vicinity of the peripheral wall 4 to form a cover for the end portion 7A of the element or elements 7 where it approaches the terminal block 14. This eliminates light from the end portion 7A of the element or elements 7 being observable by a user and hence improves the aesthetic appearance of the heater in use.

The arrangement of the link 16, particularly the portion 21, provides secure location thereof in the longitudinal and lateral directions of the tunnel 11 and minimises risk of displacement of the link and contact with the portion 9A of the heating element or elements 9 which it bridges.

For operation of the heater 1, the common terminal 12 is connected to a power supply by way of a switch head 26 of the temperature-responsive device 10. The other terminals 13 and 15 are also connectable to the power supply to enable the one or more heating elements 7 of the inner heating zone 6 to be energised alone or together with the one or more heating elements 9 of the outer heating zone 8.

I claim:

1. A radiant electric heater comprising:

a base of thermal insulation material having supported relative thereto at least two concentrically-arranged heating elements separated by a dividing wall of thermal insulation material to form an outer heating zone and an inner heating zone, the heater having a peripheral wall of thermal insulation material;

a tunnel formed of thermal insulation material extending between the peripheral wall and the dividing wall across the outer heating zone;

a rod-like temperature-responsive device extending from a periphery of the heater through the tunnel and at least partly across the inner heating zone, through an aperture provided in the dividing wall;

at least one end portion of at least one heating element of the inner heating zone extending along the tunnel;

a terminal block located at the periphery of the heater, the at least one end portion of the at least one heating element of the inner heating zone and at least one end portion of at least one heating element of the outer heating zone being electrically connected to terminals provided in the terminal block; and an elongate electrically conductive link having a first end electrically connected to, or comprising, one of the terminals and extending to bridge, whilst being electrically insulated from, an end portion of the at least one heating element of the outer heating zone electrically connected to another terminal, the link being profiled such that a second end thereof is located within the tunnel and electrically connected to an end portion of the at least one heating element of the inner heating zone.

2. A heater according to claim 1, wherein the at least one heating element of the outer heating zone is substantially absent from an area occupied by the tunnel.

3. A heater according to claim 1, wherein the electrically conductive link is of substantially rigid form.

4. A heater according to claim 3, wherein the link is arranged to bridge, in spaced relationship with, the end portion of the at least one heating element of the outer heating zone.

5. A heater according to claim 1, wherein the tunnel has a lower side edge profiled to accommodate entry of the link into the tunnel.

6. A heater according to claim 5, wherein the profiled lower side edge of the tunnel additionally provides secure location for the link.

7. A heater according to claim 5, wherein the lower side edge of the tunnel is profiled in a manner selected from notches, apertures, rebates and grooves.

8. A heater according to claim 5, wherein the link is substantially secured in at least one of the longitudinal and lateral directions of the tunnel by the lower side edge of the tunnel.

9. A heater according to claim 1, wherein the second end of the link is provided with means for securing the link to the base of thermal insulation material.

10. A heater according to claim 9, wherein the means for securing the second end of the link to the base is selected from a spike and a pin.

11. A heater according to claim 10, wherein the securing means is integral with the second end of the link.

12. A heater according to claim 10, wherein the securing means is separate from the second end of the link.

13. A heater according to claim 1, wherein the link is profiled such that it has a first upwardly-directed portion in the region of the first end thereof, a second laterally-directed portion crossing over the end portion of the at least one heating element of the outer heating zone, a third portion downwardly directed towards the base and a fourth portion laterally directed into the tunnel at the second end of the link.

14. A heater according to claim 1, wherein the second end of the link is welded to the end portion of the at least one heating element of the inner heating zone.

15. A heater according to claim 1, wherein the link comprises metal.

16. A heater according to claim 15, wherein the link is of strip form.

17. A heater according to claim 1, wherein another end portion of the at least one heating element of the inner heating zone is electrically connected to a different terminal in the terminal block from that terminal electrically connected to, or comprising, the link.

18. A heater according to claim 17, wherein the tunnel is provided with a laterally-extending portion proximate the peripheral wall and adapted to shield such other end portion of the at least one heating element of the inner heating zone.

19. A heater according to claim 17, wherein such other end portion of the at least one heating element of the inner heating zone is electrically connected to the same terminal in the terminal block as the bridged end portion of the at least one heating element of the outer heating zone.

20. A heater according to claim 1, wherein at least one of the tunnel, the peripheral wall and the dividing wall comprises bound vermiculite.

21. A heater according to claim 1, wherein the tunnel is integral with at least one of the dividing wall and the peripheral wall.

22. A heater according to claim 1, wherein the base comprises microporous thermal and electrical insulation material.

23. A heater according to claim 1, wherein the heating elements are of ribbon form.

24. A heater according to claim 23, wherein the heating elements are supported edgewise on the base.

* * * * *